US011441560B2

(12) United States Patent
Dicks et al.

(10) Patent No.: US 11,441,560 B2
(45) Date of Patent: Sep. 13, 2022

(54) PUMP HOUSING WITH DUAL-PURPOSE INLET FITTING

(71) Applicant: SEEPEX GMBH, Bottrop (DE)

(72) Inventors: Norman Dicks, Geldern (DE); Marcel Griesdorn, Bottrop (DE); Stephan Mottyll, Herne (DE)

(73) Assignee: SEEPEX GMBH, Bottrop (DE)

( * ) Notice: Subject to any disclaimer, the term of this patent is extended or adjusted under 35 U.S.C. 154(b) by 0 days.

(21) Appl. No.: 17/058,818

(22) PCT Filed: Apr. 17, 2019

(86) PCT No.: PCT/EP2019/059925
§ 371 (c)(1),
(2) Date: Jan. 12, 2021

(87) PCT Pub. No.: WO2020/015873
PCT Pub. Date: Jan. 23, 2020

(65) Prior Publication Data

US 2021/0140428 A1 May 13, 2021

(30) Foreign Application Priority Data

Jul. 18, 2018 (DE) ..... 10 2018 117 374.1

(51) Int. Cl.
*F04C 2/107* (2006.01)
*F04C 2/16* (2006.01)
(Continued)

(52) U.S. Cl.
CPC ..... *F04C 2/1071* (2013.01); *F04C 2/1073* (2013.01); *F04C 2/16* (2013.01);
(Continued)

(58) Field of Classification Search
CPC ..... F04C 2/1071–1075; F04C 18/1075; F04C 13/005; F04C 29/0092; F04C 29/12;
(Continued)

(56) References Cited

U.S. PATENT DOCUMENTS 4,637,785 A * 1/1987 Backstrom ..... F04C 13/002 241/185.6
2015/0118085 A1* 4/2015 Lessmann ..... F04C 14/28 418/1

FOREIGN PATENT DOCUMENTS

DE 370281 C * 3/1923 ..... B65G 45/005
DE 8212381 U1 * 11/1989 ..... F04C 2/107
(Continued)

*Primary Examiner* — Laert Dounis
(74) *Attorney, Agent, or Firm* — Andrew Wilford

(57) ABSTRACT

A pump housing (4) for an eccentric screw pump, comprising a housing casing (5) extending along a housing longitudinal axis (L), a first end-face opening (6), to which a shaft seal (7) for a connection shaft (8) can be connected, and a second end-face opening (10), to which a stator (I) can be connected, and comprising a tubular inlet nozzle (11), oriented transversely to the housing longitudinal axis (L), for feeding a medium that is to be conveyed, which inlet nozzle is connected to the housing casing (5) tangentially, offset in relation to the housing longitudinal axis (L). The geometry of the inlet nozzle (11) is designed in such a way that, as the medium flows into the housing interior through the inlet nozzle (II), a flow (S) is generated which has a radial direction component (RI) directed away outwardly from the housing longitudinal axis (L) and/or an axial direction component (R2) directed towards the first end-face opening (6).

13 Claims, 5 Drawing Sheets

(51) Int. Cl.

| | |
|---|---|
| ***F04C 15/00*** | (2006.01) |
| ***F04C 13/00*** | (2006.01) |
| ***F04C 18/107*** | (2006.01) |
| ***F04C 15/06*** | (2006.01) |

(52) U.S. Cl.
CPC ..... *F04C 13/005* (2013.01); *F04C 15/0065* (2013.01); *F04C 15/06* (2013.01); *F04C 18/1075* (2013.01); *F04C 2240/30* (2013.01); *F04C 2240/60* (2013.01); *F04C 2250/101* (2013.01)

(58) Field of Classification Search
CPC ..... F04C 15/06; F04C 2250/10–101; F01C 1/101; F01C 21/18; B65G 45/005
See application file for complete search history.

(56) References Cited

FOREIGN PATENT DOCUMENTS

| | | | | | |
|---|---|---|---|---|---|
| DE | 3818508 | A | | 12/1989 | |
| DE | 3818508 | A1 | * | 12/1989 | ..... F04C 13/005 |
| DE | 29715797 | U | | 2/1998 | |
| DE | 19812154 | A1 | * | 9/1999 | ..... F04C 2/1073 |
| DE | 102008014235 | A | | 9/2008 | |
| DE | 102010034032 | A1 | * | 2/2012 | ..... B28C 5/1292 |
| DE | 102012001617 | A | | 8/2013 | |
| JP | 2003267415 | A | * | 9/2003 | ..... F04C 2/1073 |

* cited by examiner

PUMP HOUSING WITH DUAL-PURPOSE INLET FITTING

CROSS REFERENCE TO RELATED APPLICATIONS

This application is the US-national stage of PCT application PCT/EP2019/059925 filed 17 Apr. 2019 and claiming the priority of German patent application 102018117374.1 itself filed 18 Jul. 2018.

BACKGROUND OF THE INVENTION

The invention relates to a pump housing for an eccentric screw pump. The pump housing has a casing extending along a housing axis and a (drive-side) upstream end at which a shaft seal for a connection shaft is connectable, as well as a (stator-side) downstream end to which a stator is connectable.

Furthermore, the pump housing has an inlet fitting of a tubular shape that is oriented transversely to the housing axis inlet fitting for supplying a medium to be conveyed (by the pump).

The invention also relates to an eccentric screw pump with such a pump housing, which is also referred to as the suction housing. Such an eccentric screw pump has a stator and a rotor rotating in the stator, and the described pump housing is connected to the stator at the downstream suction side, which is also called the suction housing. The eccentric screw pump also has a drive for rotating the rotor, the drive for example connected to the rotor via a connecting shaft and a coupling rod. The coupling rod compensates for eccentric movement of the rotor or the rotor end opposite the connecting shaft. For a liquid-tight sealing of the pump housing against the environment a shaft seal is provided which for example can be formed as a mechanical seal. The casing of the pump housing or of the pump housing is (essentially) cylindrical at least in some areas, namely preferably at least at the inlet fitting. The housing longitudinal axis corresponds to in this case the axis of the cylinder.

Such an eccentric screw pump is a pump from the group of rotating displacement pumps used for pumping a wide variety of media and in particular highly viscous liquids in a wide variety of industries. The conveyed liquids can for example also contain solids. The pump housing according to the invention or the eccentric screw pump according to the invention is preferably a food pump and consequently preferred for conveying food. It is also known as a sanitary pump and is used wherever clean work must be carried out in a sterile and hygienic manner, especially in the food, pharmaceutical, cosmetics and chemical industry. Such pumps follow strict sanitary regulations.

This means that there has to be with such food pumps or sanitary pumps a particular effective method of cleaning the pump and especially the pump housing. During cleaning, a for example cleaning medium is circulated by the operating pump or a separately connected cleaning pump so as to clean the pump and the suction housing. The cleaning medium is consequently fed in through the inlet fitting, which in normal operation of the pump also serves to supply the medium to be conveyed and the rotor pumps it through the suction housing and the stator into a pressure fitting connected to the downstream end of the stator. This produced a so-called clean-in-place rinse that makes it possible to clean all surfaces in the pumps that come into contact with the product with minimal disassembly. In practice, discharge areas close to the wall and in eccentric screw pumps and dead space areas can critically interfere with cleaning. It can be particularly critical in the practice for example in the housing around the shaft seal (e.g. mechanical seal).

Thus, in conventional eccentric screw pumps or their pump housings, the inlet fitting is connected centrally and consequently radially to the cylindrical casing, usually adjacent the mechanical seal, for example near the upstream end of the suction housing. The cleaning fluid flowing into the inlet fitting is dispersed when it hits the split mechanical seal, so that cleaning fluid is also in the area below the mechanical seal. Nevertheless, due to the breakdown during cleaning there can be inadequate flow under the mechanical seal, which causes problems. The division of the flow can also lead to stagnation above the mechanical seal and this can lead to problems when cleaning above the mechanical seal.

To improve the cleaning, solutions are known from practice in which the inlet fitting is not connected centrally or radially, but tangentially to the casing so that there is no split flow, but a one-sided, continuous flow around the mechanical seal. Such a housing geometry for a pump housing of an eccentric screw pump is for example described in DE 10 2008 014 235.

DE 297 15 797 discloses a suction housing of an eccentric screw pump in a special design. The suction housing extends radially from the casing at the upstream inlet port for the medium to be conveyed. For cleaning purposes additional pipe sockets are connected, which are used to generate turbulent pipe flows in the suction housing, especially adjacent the hinge connections and set at an angle. The cleaning takes place not through the inlet port, so that the cleaning medium is, even when the pump itself is not operating, conveyed through the pump, and the cleaning medium is in a special cleaning operation when the rotor is at a standstill by the special cleaning fitting funded.

An eccentric screw pump of the usual type is for example also known from DE 10 2012 001 617. The inlet is connected radially to the casing in a conventional manner, adjacent the mechanical seal. The pump has a storage space adjacent the transition to the stator, which storage space is free of recesses and/or bulges, which is particularly good and even required in the field of food technology with respect to cleanability and sanitary operation.

OBJECT OF THE INVENTION

Based on the known prior art, the object of the invention invention is to provide a pump housing for an eccentric screw pump, in particular a food or sanitary pump of the type described above, characterized by simple construction resulting in optimized cleaning options excels.

SUMMARY OF THE INVENTION

To achieve this object, the invention teaches a generic pump housing type as described above where the shape of the inlet fitting (incl. orientation) imparts to the medium flowing through the inlet fitting into the housing a component of movement (at the transition between the inlet fitting and the casing) that is radially outward of the housing axis and/or has a component of movement axially toward the upstream end.

The invention is based on the discovery that with eccentric screw pumps for the food area or for other areas, the highest sanitary regulations for cleaning of the pump housing, which is preferably designed as a suction housing, is of particular importance. This applies in particular to clean-in-place. cleaning, in which the cleaning medium is introduced with minimal dismantling or modification work through the inlet fitting that supplies the medium to be conveyed, into the pump housing, whence the rotor moves it through the pump housing and the stator. The invention first of all comprises embodiments in which the inlet fitting is centrally connected to the housing on the longitudinal axis of the cylindrical casing. It is however preferred that the inlet fitting be (eccentrically) offset to the housing axis (essentially) tangentially connected to the casing. Thus it always has the invention shape for generating the described flow components.

The invention has recognized that cleaning is done by a decentralized connection of the inlet fitting and consequently a (substantially) tangential arrangement of the inlet fitting is optimal. This basically known tangential connection is however, according to the invention, further optimized, specifically by a shape that has an asymmetrical and preferably a double asymmetrical "flow" or inflow into the pump housing in particular adjacent the mechanical seal. The cleaning medium consequently does not flow exactly tangentially through the inlet fitting into the interior of the housing, but (at the transition from the inlet fitting to the housing interior) on the one hand the medium is partly diverted radially outward toward the housing outer wall to and consequently away from the housing axis, so that a particularly effective circulation is generated around the mechanical seal here. Thus the inner wall of the suction housing is better cleaned and dead spaces that may occur in practice dead space areas below and/or above the mechanical seal are avoided. Preferably, the inflow is also directed toward the upstream end face of the suction housing and consequently toward the upstream end of the suction housing, so that thereby the end face of the suction housing is better cleaned and also the wall areas below the mechanical seal and the sealing points between the mechanical seal and suction housing.

The shape of the inlet fitting according to the invention can moreover not only be found in the preferred embodiment in which the inlet fitting is offset eccentrically to the housing longitudinal axis, but in conventional embodiments with central inlet fittings connected to the casing.

The cleaning is consequently effected according to the invention by on the one hand flow directed specifically radially outward from the housing longitudinal axis and, on the other hand, by flow onto the upstream face of the suction housing and consequently by a special radial component and/or a special axial component of the flow. These two measures can be independent of each other and preferably be implemented in combination. Overall, according to the invention, high flow speeds or high speed gradients on the wall lead to a considerable reduction in dead spaces and improved cleaning of the walls.

The shape according to the invention can be used in a first embodiment, in that for example the inner cross-sectional area of the inlet fitting decreases toward the casing, that is in the direction of inflow, at least in sections, to be precise preferably asymmetrical and particularly preferably doubly asymmetrical. The reduction of the cross-section leads to an advantageous increase in the inflow velocity and thus to better cleaning results. For this purpose for example the outlet cross-section of the inlet port (adjacent the casing) can be reduced relative to its inlet cross section. Optional or in addition, the output cross-section is related to the input cross-section along the length of the input fitting, asymmetrically offset, preferably axially to the upstream housing end and/or radially outward from the housing longitudinal axis away from the outside or offset toward the housing outer wall. The described asymmetrical offset of the output cross-section relative to the inlet cross-section of the inlet fitting can be used to impart to the flow according to the invention the above-mentioned radial direction component and/or the above-mentioned axial direction component. Both the output cross-section and the input cross-section (in a plan view of the fitting) are round, but with different diameters. Alternatively, there is the possibility that the output cross-section and/or the input cross-section is not round, but for example are oval or elliptical, however also in the manner described with a reduced output cross-section relative to the inlet cross-section. After all, other cross-sectional shapes can be used so that an individual adaptation of the shape is possible. In any case, according to the invention, there is directed inflow and, if necessary, an increase in the inflow velocity through a cross-sectional restriction.

In an alternative embodiment, it is provided that the inlet fitting has a spiral-shaped inner wall which is designed and thus forms a spiral-shaped flow passage generating a spiral flow inside the inlet fitting, so that the medium enters in the orientation defined according to the invention from the inlet fitting into the interior the pump housing. The orientation of the flow is essential to the invention. In this embodiment, the direction of flow of the medium is consequently realized in the form of a spiral-shaped inner wall of the inlet fitting.

There is the possibility that the inlet fitting described is designed geometrically, that is the inlet port itself is similar to that described asymmetrical cross-sectional taper or with the spiral-shaped one described. The pump housing is consequently in the course of manufacture made with the shape according to the invention. The pump housing is here preferably made of stainless steel. Alternatively, it can also be made of cast steel. Further alternatively, embodiments made of plastic are also possible.

In an alternative embodiment, however, there is also the possibility of a using specially designed fitting insert that fits in a (conventional) cylindrical inlet fitting and thus retrofits it with the flow-generating shape of the invention. Such a separately manufactured fitting insert can for example also be installed when retrofitting a pump with a classic tangential connection cylindrical inlet fitting. The fitting insert can for example be made of stainless steel, cast steel, or plastic.

The invention also relates to an eccentric screw pump with a pump housing of the type described. Such an eccentric screw pump has in addition to the pump housing/suction housing, a stator connected to a downstream end of the suction housing, a rotor in the stator, a coupling rod in the pump housing, and a drive connected to the coupling rod via a connecting shaft. The drive consequently drives the connecting shaft, which in turn drives the rotor via a coupling rod. The cab rod can for example in a basically known manner be connected via joints to the rotor on the one hand and the connecting shaft on the other. Joints that are easy to assemble are preferably used for improved cleaning. Optionally, in the transition areas between the connecting shaft and the coupling rod on the one hand, and the coupling rod and rotor on the other hand, also classic joints need not be used. In this case, for example the use of a flexible or flexurally elastic coupling rod is possible, for example from titanium. A flexible coupling rod can also be connected directly in one piece to the rotor.

In any case, there is inside the pump housing adjacent the (drive-side) end face opening a shaft seal, for example a mechanical seal, for sealing the suction housing. The inlet fitting is adjacent the shaft seal, that is up adjacent the shaft seal in the casing, so that the shaft seal is by the medium being conveyed, for example the cleaning medium.

Even if the cleaning medium is fed in via the inlet fitting, which during the normal operation of the pump is used to supply the medium to be conveyed, in a possible further development, the pump housing or the pump can also be provided with one or more bypass openings or connections. Thus the pump housing, which is designed as a suction housing, carries in the vicinity of the downstream end and a downstream bypass fitting near the stator and extending transverse to the housing direction. At the other end of the stator opposite the suction housing there is for example a pressure port. This pressure port can have a second bypass fitting, which extends transversely to the axis of the housing, and the two bypass ports are connected to one another via a bypass line. Such a bypass is used in a clean-in-place operation to remove excess cleaning medium that is not conveyed through the stator chambers from the suction housing to service the pressure housing. It is important that this bypass port is not a separate supplier of cleaning medium, but is used in the course of cleaning by pump operation with rotating rotor, with the cleaning medium being supplied via the inlet fitting.

According to another feature of this invention the pump housing has a removable inner liner in an outer wall of the inlet fitting and shaped to impart the components of slow to the medium flowing in through the inlet fitting.

Finally, the invention also relates to a method of cleaning a eccentric screw pump of the type described. This method is characterized in that with the rotating rotor draws a cleaning medium from the inlet fitting through the stator via the suction housing, where the mechanical seal is surrounded by a flow whose inflow direction has a component directed radially outward away from the housing longitudinal axis and/or to the first axial directional component executed on the upstream end (and consequently the main flow direction has an opposite directional component).

BRIEF DESCRIPTION OF THE DRAWING

In the following, the invention is explained with reference to drawings, which only represent embodiments. Therein.

SPECIFIC DESCRIPTION OF THE INVENTION

Figure 1:
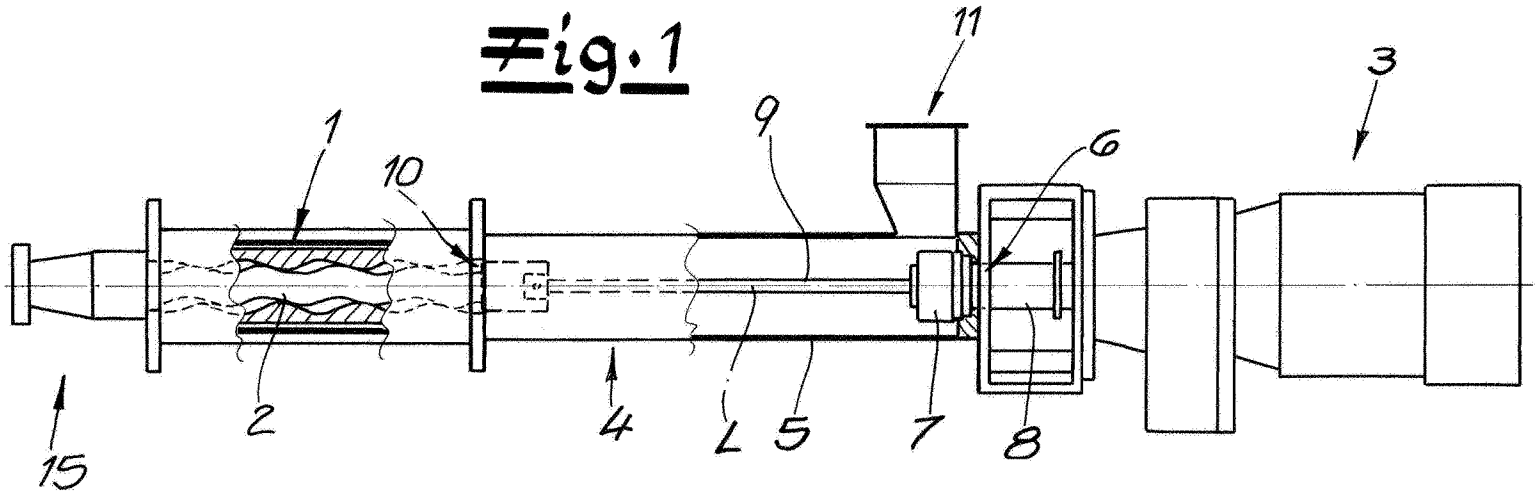
FIG. 1 shows an eccentric screw pump in a simplified view.

In the drawing, the basic structure of an eccentric screw pump is shown in simplified form as a stator 1, a rotor 2 rotating in the stator 1, and a drive 3 for the rotor. For example, a pump or so-called suction housing 4 is attached to the upstream suction end of the stator 1. The downstream pressure end of the stator 1 is for example constituted as a connecting piece or pressure port 15. The pump housing 4 has a casing 5 extending longitudinally along an axis L and that here is cylindrical so that the housing longitudinal axis L is the cylinder axis L.

An output shaft 8 of the drive 3 rotates the rotor 2 via a coupling rod 9 that compensates for eccentric movement of the rotor 2 or its upstream end. This is done by joints or also possibly a flexible coupling rod. Details are not shown.

The pump housing 4 has an upstream end 6 holding a shaft seal 7 sealing around the connecting shaft 8. Furthermore, the pump housing 4 has a downstream end 10 to which the stator 1 is fixed. In addition, the pump housing 4 has for supplying medium to be conveyed a tubular inlet fitting 11 extending transversely from the housing longitudinal axis or the cylinder axis L and connected to the casing 5. Here this inlet fitting 11 is not centered and is therefore essentially offset from the housing axis L and connected tangentially to the casing 5.

In normal operation, the medium to be conveyed is fed via the inlet fitting 11 into the suction housing 4 at its upstream end 6 and is thence pumped through the stator 1 to the pressure port 15. To clean the pump, the inlet port 11 is supplied with a cleaning medium that is during operation moved by the pump through the rotor. The already mentioned decentralized, tangential connection of the inlet fitting 11 to the casing 5 creates an optimized flow around the mechanical seal 7 and thus enhances cleaning of the areas below and/or above the mechanical seal 7. According to the invention, the shape of the inlet fitting is not only tangential, rather, it is designed in such a way that the flowing medium or cleaning medium moves through the inlet fitting 11 into the interior of the housing in an inflow direction R that has a directional component R1 radially away from the axis L of the housing 4 and a component R2 axially toward the upstream end 6. For this purpose, reference is made to FIGS. 2 and 3. The direction of flow R is the direction of flow S of the medium from the transition from the inlet fitting 11 to the interior of the housing or casing 5.

Figure 3:
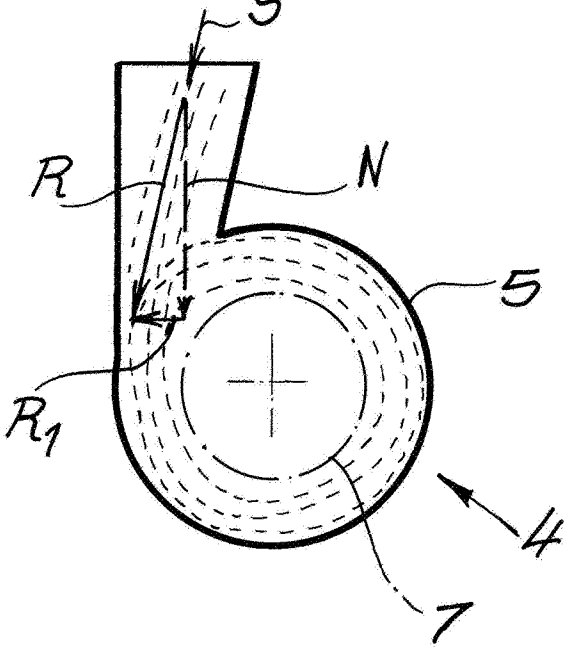
FIG. 3 is a second section through the structure shown in FIG. 2.

FIG. 3 shows that there is not exactly tangential inflow or that the direction of flow R is not exactly tangential to the inner surface of the casing 5, but is directed radially outwardly away from the housing axis L. Flow is generated, that is the flow has a radial outward component R1 of movement away from the housing longitudinal axis. FIG. 3 also shows that the inflow direction R compared to the conventional tangential orientation (or vertical) N is directed away from the radially outward with the radial direction component R1. This flow R against the inner surface of the casing creates improved circulation around the mechanical seal 7 and thus scours the inner wall of the casing 5. In addition, dead spaces below and above the mechanical seal 7 are avoided.

Figure 2:
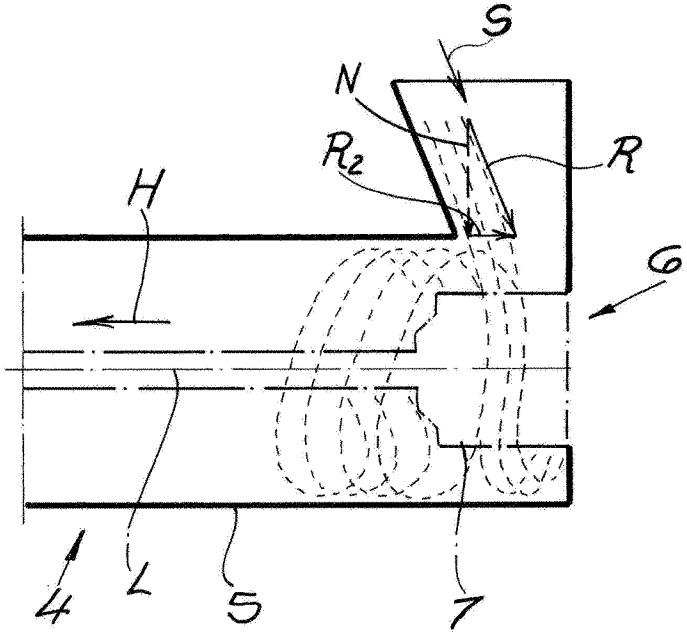
FIG. 2 is a schematically simplified first section through an eccentric screw pump at the inlet fitting.

In addition, in the embodiment according to the invention, the main flow direction H of the housing flow S is away from the upstream end 6. For this purpose, reference is made to FIG. 2 that shows how the flow S or inflow direction R is directed axially toward the upstream end 6 with directional component R2 consequently opposite to the main flow direction H of the pump. In FIG. 2 also, the conventional orientation is indicated by reference N, so that it can be seen that the direction of flow R, unlike this conventional vertical direction N, is instead toward the upstream end of the suction housing 4. This resultant axial component R2 is shown in FIG. 2. This deflection of the flow S axially against the mechanical seal 7 leads to improved cleaning of the upstream end face of the suction housing 4. Furthermore as a result, the wall areas below and/or above the mechanical seal 7 are scoured better.

Figure 4:
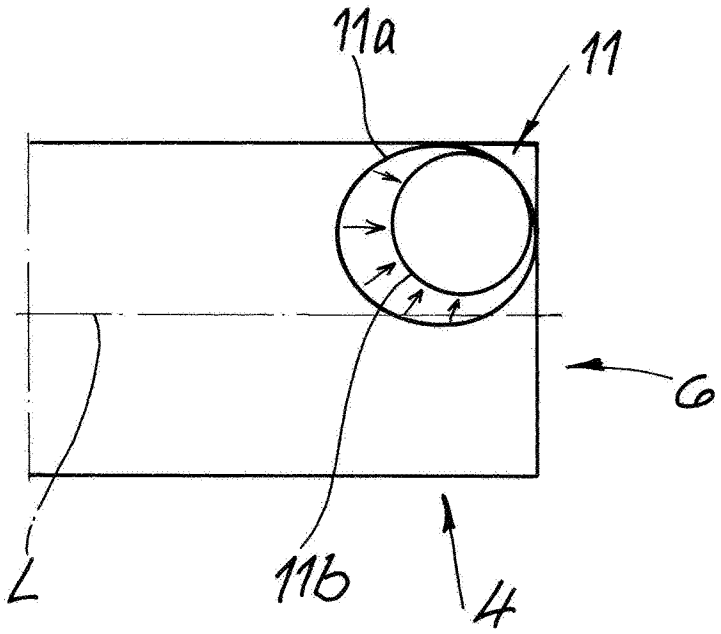
FIG. 4 is a simplified top view of the structure shown in FIG. 2, FIGS. 5A to 5D are views like FIG. 4 showing modified embodiments of the structure.

In the embodiment in FIGS. 2 to 4, this shape according to the invention is realized in that the cross-sectional area of the inlet fitting 11 decreases toward the casing 5 asymmetrically. This means that the cross-sectional area of an output end 11*b* of the inlet fitting 11 in plan view is reduced relative to that of the upper input end 11*a* and, in addition, is offset from the center. In the embodiment shown, the output end 11*b* is offset both axially toward the upstream end-face housing opening 6 and radially outward away from the housing longitudinal axis L (see FIG. 4). This creates the advantageous flow conditions described.

Figure 5C:
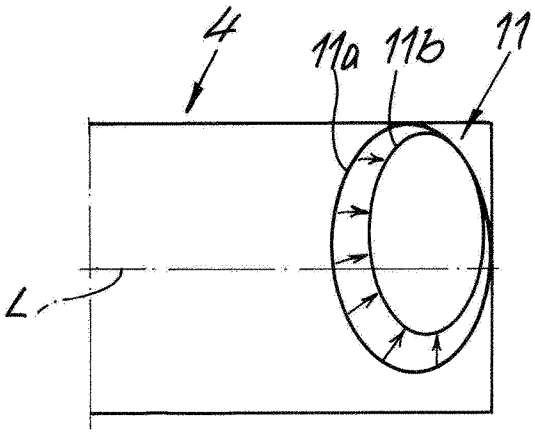
Figure 5D:
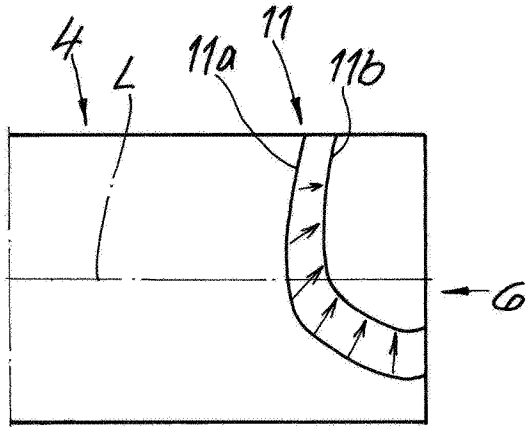
Figure 5A:
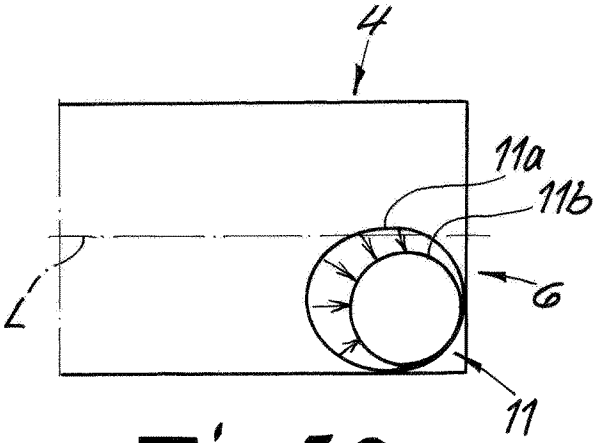
Figure 5B:
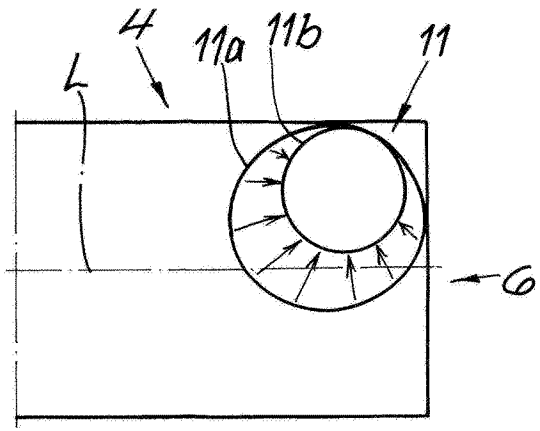

FIGS. 5A, 5B, 5C and 5D show modifications of the embodiment according to FIG. 4. FIG. 5A shows an embodiment in which the inlet fitting compared to FIG. 4 is connected on the other side of the housing relative to the longitudinal axis L, so that the embodiment according to FIG. 5A is preferably used for a direction of rotation of the pump that is reversed from that of FIG. 4. The embodiment according to FIG. 5B differs from that according to FIG. 5A in particular by other dimensioning of the cross-sectional taper. While FIGS. 4-5A and 5B 5C show embodiments with round cross-sections, a modified embodiment with a non-round cross-section, e.g. an oval or elliptical cross-section is shown in FIG. 5D. FIG. 5D shows an optional configuration with a variably one cross section of the inlet port.

Figure 6:
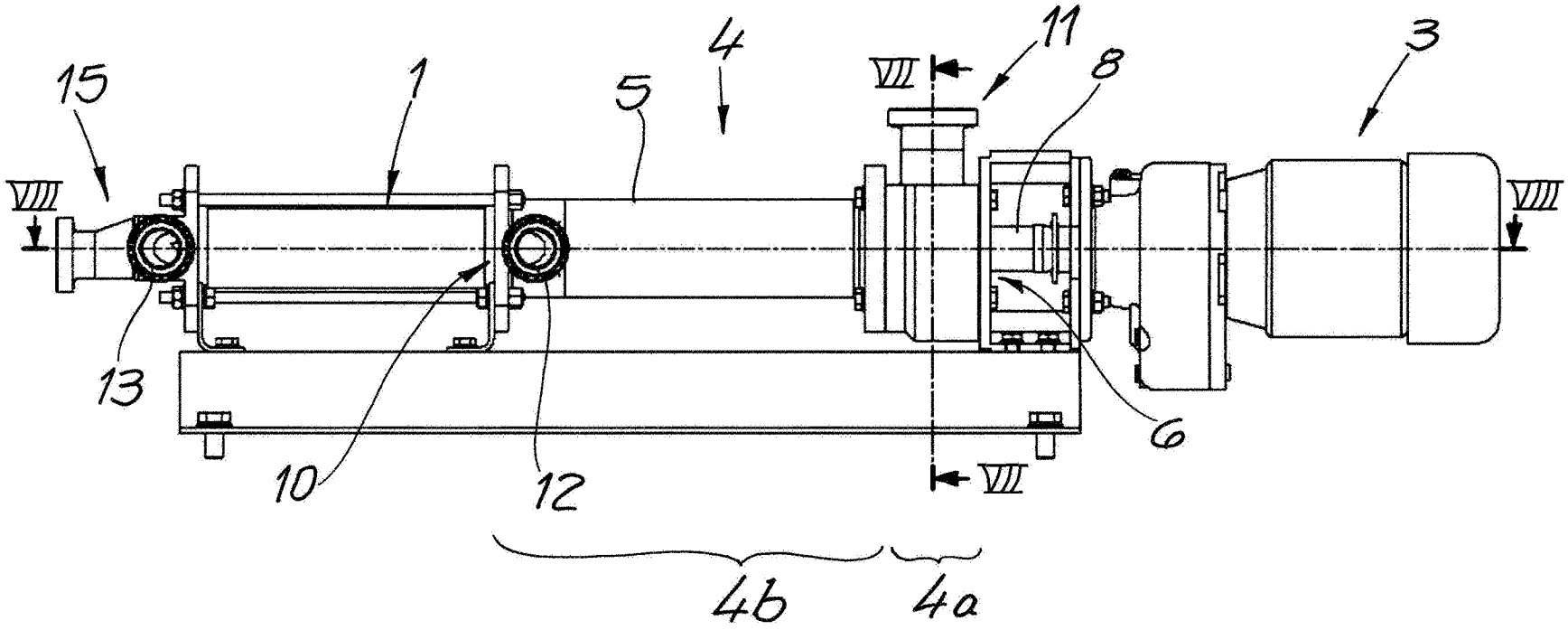
FIG. 6 shows a second embodiment of an eccentric screw pump according to the invention.
Figure 7:
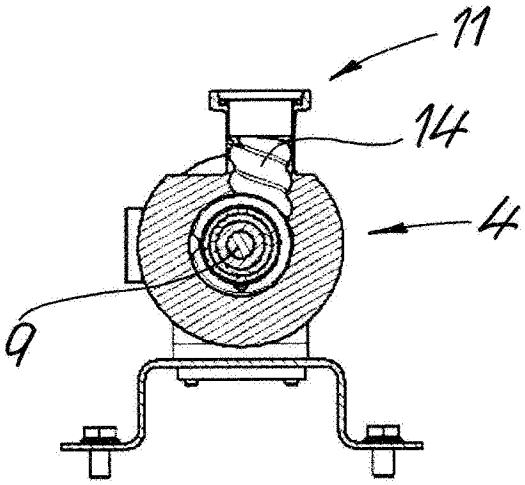
FIG. 7 is cross section A-A through the structure of FIG. 6
Figure 8:
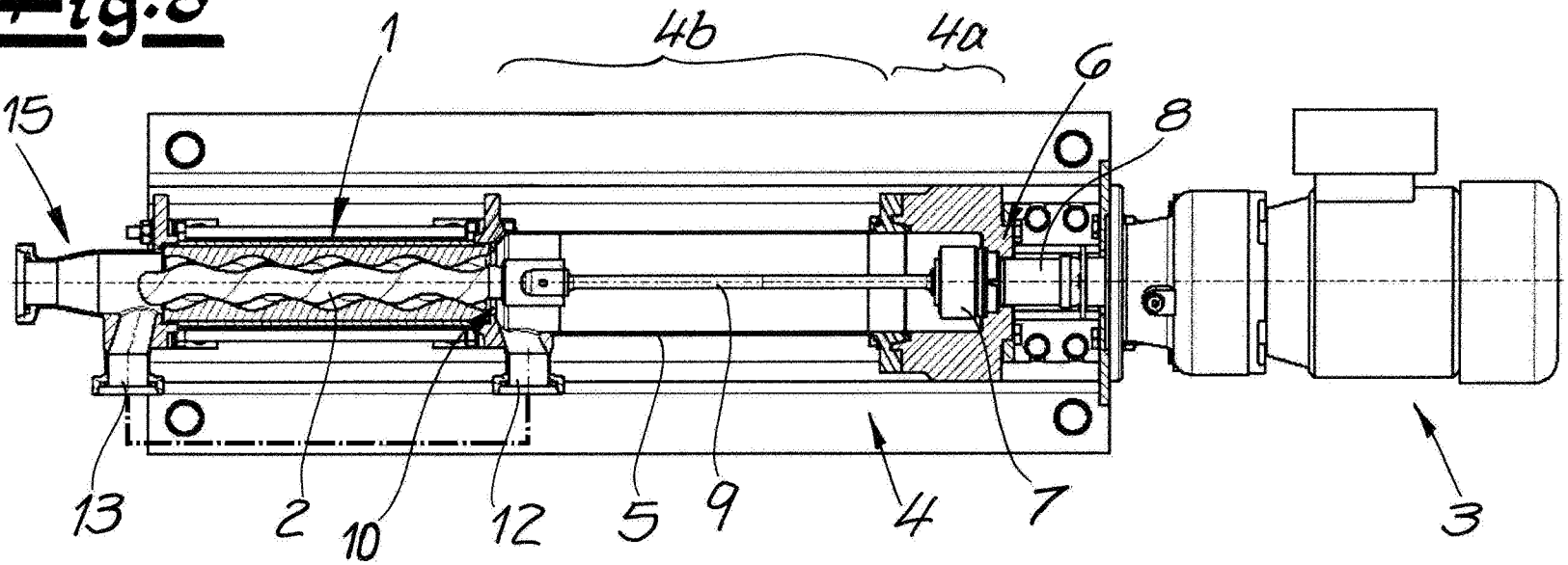
FIG. 8 is section B-B through the structure of FIG. 6.

FIGS. 6 to 8 show a modified embodiment of the invention, in which the asymmetrical flow S or R is generated according to the invention through a special inlet fitting 11 having a spiral-shaped inner wall 14 that forms a spiral-shaped flow passage, so that the inlet fitting 11 generates a spiral-shaped flow that as described above has a radial directional component R1 and an axial direction component R2 when it enters the interior of the housing. Also with this in the embodiment, the inflow, which is essential to the invention, can consequently be provide improved cleaning.

In addition, in the embodiment according to FIGS. 6 to 8, there are two bypass ports 12 and 13 provided are connected to one another with an unillustrated bypass line. The first bypass connection 12 is connected to the suction housing 4, specifically near the downstream end 10 of the suction housing 4. The second bypass connection 13 is connected to the pressure port 15. The cleaning medium used to clean the pump also in the embodiment according to FIGS. 6 to 8, is supplied via the inlet fitting 11 and the pump conveys it through the pump by the rotor 2. In doing so, however the cleaning medium exits via the second bypass port 13 and is fed back by bypass line to the first bypass connection 12 and thus a special efficient cleaning of the pump and especially the stator can be realized. This design with bypass connections can be made in the same way in the embodiment according to the FIGS. 1 to 5 implement, that is with one of the bypass ports 12, 13 or both bypass ports 12, 13 can be connected to the inlet fitting 11 as described. The shape explained in the description and in the claims of the inlet fitting 11 consequently relates in an optional further development to invention also to one or more possibly provided bypass fittings.

Furthermore, FIGS. 6 to 8 show by way of example that the pump or suction housing 4 can be made of more than one part, for example can be formed for this purpose of two housing sections 4*a*, 4*b* axially fixed together.

In the invention, only one embodiment is shown in which the inlet fitting 11 is arranged eccentrically offset with respect to the longitudinal axis L of the pump. However, the shape of the inlet fitting 11 according to the invention can be used even with other than the variant shown, whereby the inlet fitting is centrally oriented to the longitudinal axis L. In such an embodiment, the shapes show for example those in the drawing can be used. The same applies to the possibility of a spiral-shaped flow passage.

The invention claimed is:

1. A pump housing for an eccentric screw pump, the housing comprising:

a casing extending along a housing axis, a connecting shaft in the casing, a shaft seal at an upstream end of the casing and surrounding the connecting shaft, a stator mounted at a downstream end of the casing, and a tubular inlet fitting for the housing, projecting transversely from the housing axis for supplying a medium to be conveyed, the shape of the inlet fitting being such that a flow of medium into the housing through the inlet fitting is in an inflow direction that has a flow component directed radially outward from the housing axis and a flow component directed axially toward the upstream end, an inner cross-sectional area of the inlet fitting tapering at least partially toward the casing such that an output cross-sectional area of the inlet fitting is smaller than an inlet cross-sectional area thereof and/or is asymmetrically offset.

2. The pump housing according to claim 1, wherein the casing is essentially cylindrical at least adjacent the inlet fitting.

3. The pump housing according to claim 1, wherein an inlet cross-sectional area of the inlet fitting is asymmetrically offset axially toward the upstream housing opening and/or radially outwardly away from the housing longitudinal axis.

4. A pump housing for an eccentric screw pump, the housing comprising:

a casing extending along a housing axis, a connecting shaft in the casing, a shaft seal at an upstream end of the casing and surrounding the connecting shaft, a stator mounted at a downstream end of the casing, and a tubular inlet fitting for the housing, projecting transversely from the housing axis for supplying a medium to be conveyed, the shape of the inlet fitting being such that a flow of medium into the housing through the inlet fitting is in an inflow direction that has a flow component directed radially outward from the housing axis and a flow component directed axially toward the upstream end, the inlet fitting having an inner wall shaped to form a spiral flow passage.

5. The pump housing according to claim 1, wherein the inlet fitting is offset tangentially to the axis of the casing.

6. The pump housing according claim 1, wherein the pump housing is formed by two axially joined housing sections.

7. The pump housing according to claim 1, further comprising;

a bypass fitting on the pump housing at the downstream end thereof and extending transversely from the housing axis.

8. The pump housing according to claim 1, further comprising:

a removable inner liner in an outer wall of the inlet fitting and shaped to impart the component(s) of flow to the medium flowing in through the inlet fitting.

9. An eccentric screw pump comprising:

a pump casing extending along an axis and having an upstream end and a downstream end, a stator connected to the downstream end, a rotor in the stator, a coupling rod in the pump casing, a drive having a shaft connected to the coupling rod, a shaft seal provided on the pump casing at the upstream end for sealing around the shaft, and an inlet fitting opening into the casing adjacent the shaft seal so that medium flows into the casing through the fitting and then around the shaft seal with a component of flow directed radially outward from the axis and a component of flow directed axially toward the upstream end, an inner cross-sectional area of the inlet fitting tapering at least partially toward the casing such that an output cross-sectional area of the inlet fitting is smaller than an inlet cross-sectional area thereof and/or is asymmetrically offset.

10. The eccentric screw pump according to claim 9, further comprising:

a first bypass fitting on the pump casing adjacent the downstream end and extending transversely to the axis, a pressure fitting at an end of the stator opposite the pump casing, a second bypass fitting also extending transversely to the longitudinal axis of the casing from a downstream end of the stator, and a bypass conduit extending between the bypass fittings for moving the medium between the bypass fittings from the stator output to the stator input.

11. A method of cleaning an eccentric screw pump according to claim 9, the method comprising the step of:

the rotating rotor pumping the cleaning medium from the inlet fitting through the pump casing and the stator, and thereby producing flow of the medium around the shaft seal with a component directed radially outward from the axis and a component directed axially toward the upstream end.

12. An eccentric screw pump comprising:

a pump casing extending along an axis and having an upstream end and a downstream end, a stator connected to the downstream end, a rotor in the stator, a coupling rod in the pump casing, a drive having a shaft connected to the coupling rod, a shaft seal provided on the pump casing and at upstream end for sealing around the shaft, and an inlet fitting opening into the casing adjacent the shaft seal so that medium flows into the casing through the fitting and then around the shaft seal with a component of flow directed radially outward from the axis and a component of flow directed axially toward the upstream end, the inlet fitting having an inner wall shaped to form a spiral flow passage.

13. A method of cleaning an eccentric screw pump according to claim 12 comprising the step of:

the rotating rotor pumping the cleaning medium from the inlet fitting through the pump casing and the stator and thereby producing flow of the medium around the shaft seal with a component directed radially outward from the axis and a component directed axially toward the upstream end.

* * * * *